United States Patent [19]

Schluger

[11] 4,369,882

[45] Jan. 25, 1983

[54] CONTAINER FOR PRODUCT SAMPLES

[75] Inventor: Allen Schluger, New York, N.Y.

[73] Assignee: Modular Magazine Sampling Systems, Inc., New York, N.Y.

[21] Appl. No.: 275,372

[22] Filed: Jun. 19, 1981

[51] Int. Cl.[3] ..... B65D 77/00; B65D 77/26; B65D 85/00

[52] U.S. Cl. ..... 206/232; 206/216; 206/45.33; 206/459; 206/486; 206/523; 206/589; 229/87 R

[58] Field of Search ..... 206/232, 45.33, 216, 206/489, 523, 456, 589, 459, 489, 486; 229/92.8, 87 R

[56] References Cited

U.S. PATENT DOCUMENTS

| | | | |
|---|---|---|---|
| 1,686,354 | 10/1928 | Wallace | 206/232 |
| 1,689,637 | 10/1928 | Mordegai | 206/232 |
| 2,071,735 | 2/1937 | Downey | 206/489 |
| 2,422,314 | 6/1947 | Rheinstrom | 206/232 |
| 2,761,557 | 9/1956 | McLean, Jr. | 206/456 |
| 2,804,202 | 8/1957 | Davis | 206/456 |
| 3,261,456 | 7/1966 | Sparks | 206/523 |
| 3,677,399 | 7/1972 | Tatar | 206/232 |

*Primary Examiner*—William T. Dixson, Jr.
*Attorney, Agent, or Firm*—Bauer & Amer

[57] ABSTRACT

A paperboard container for use in direct mail advertising or in direct sampling of products, in which product samples are distributed to the consumer in a container which includes side panels held closed upon a sample-carrying plastic foam body by a transversely oriented closed loop disposed in encircling relation thereabout, so that while protecting the samples against breakage the container can flex to a limited degree because of limited relative movement of the side panels beneath the closed loop. The flexuring significantly contributes to proper handling of the container during distribution through normal channels of trade to the consumer.

5 Claims, 9 Drawing Figures

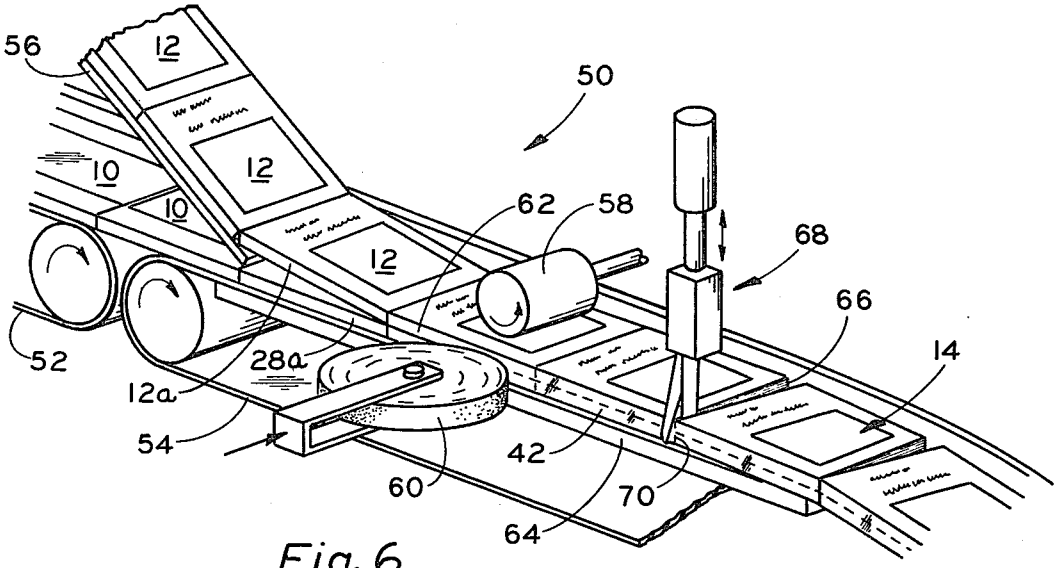
Fig. 6
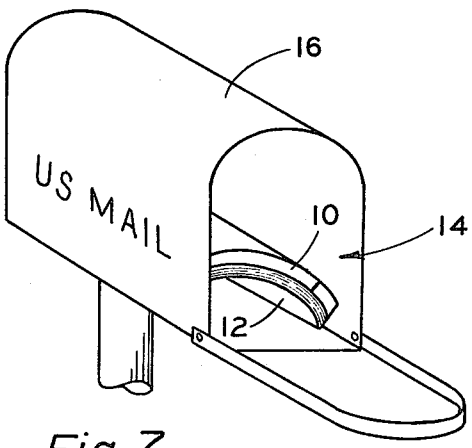
Fig. 7
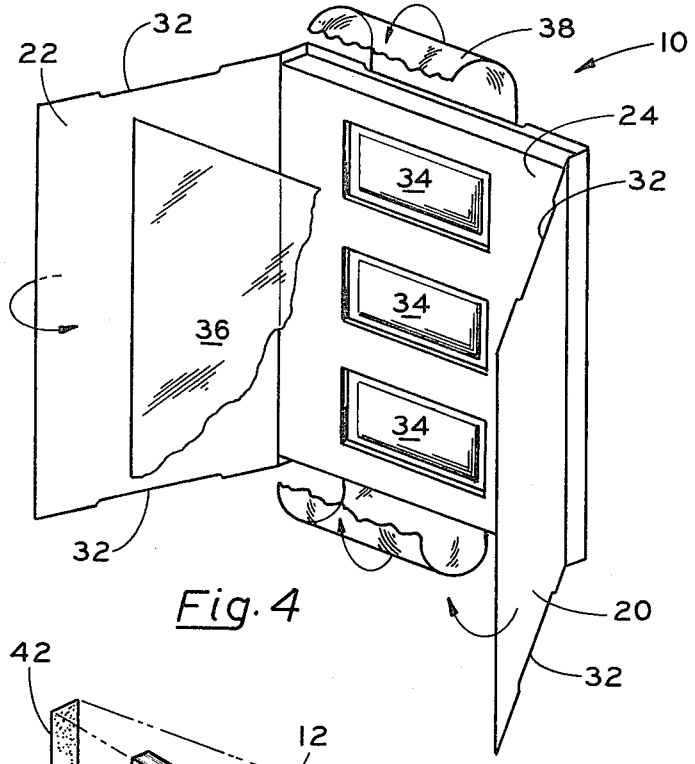
Fig. 4
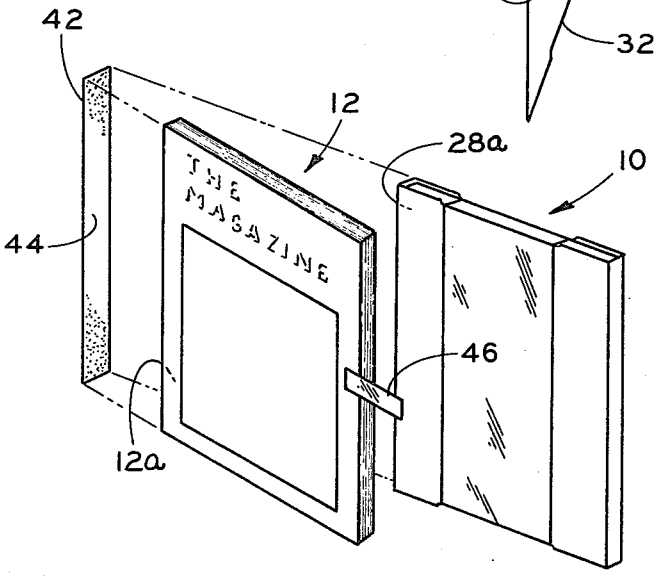

CONTAINER FOR PRODUCT SAMPLES

The present invention relates generally to improvements for a container for sample-size products, said container being intended for use alone in the distribution of such sample products or to be used in combination with magazines, newspaper sections or similar publications, and more particularly to improvements in the latter category, i.e. with magazines, etc., which significantly enhance the utility or usefulness of such publications as effective sales-generating media.

For many years there has been an area in which magazines, periodicals and newspapers have competed unsuccessfully with other forms of communication. This area is in direct mail advertising or in direct sampling of products, and the lack of success is obviously attributable to the inability of these types of publications to find a practical way of carrying multiple printed inserts, samples and other types of merchandise in a manner that would be economically feasible. The sample-carrying container proposed herein is a solution, and thus allows printed media which has heretofore been one-dimensional, to enter the realm of three-dimensional publishing. That is, by the inclusion of product samples, incentive merchandise, and three-dimensional editorial product, publishers will be strengthening their competitive position against other media by offering to their audience the ability to take advantage of all five senses. The inclusion of swatches, food samples, perfume or soap samples, records, films, and a host of other products, limited only by the editor's imagination, will now make taste, touch, smell, sound and sight a reality in magazine publishing.

Prior art efforts to achieve the foregoing have not met with success for any one or more of the following reasons. Primarily, the ability to incorporate or embody the magazine with a capability of carrying merchandise invariably has interfered with the normal magazine production line. In other instances, the resulting product could not properly be handled during distribution through normal channels of trade to the consumer.

Broadly, it is an object of the present invention to provide a combination publication and merchandise-carrying container overcoming the foregoing and other shortcomings of the prior art. Specifically, it is an object to provide a unitary structure consisting of the magazine and the merchandise carrier which is ideally suited for distribution to the consumer, wherein these components are effectively united to each other without attendant problems, the within inventive solution being essentially to embody a flexuring capability in the carrier that is compatible with that of the magazine.

A flexuring container for fragile product samples demonstrating objects and advantages of the present invention includes a paperboard blank delineated into a similarly sized rectangularly shaped back panel and a pair of opposite side panels, the latter side panels being actually attached to a pair of spacing panels each of an elongated rectangular shape and of a selected width disposed between each said side panel and an edge of said back panel. Next included in the container construction is a body of plastic foam construction material with selected portions removed to form product sample-receiving compartments, the plastic body having an operative position adhesively secured to the back panel and wherein the height thereof is of the same extent as the width of the spacing panels so that the container in cross-section is rectangular. A clear plastic sheet is disposed in covering relation over the plastic body to thereby serve as a closure for the compartments therein. Completing the container is a strip formed into a closed loop disposed in encircling relation over the operative positions of the side panels closed upon the plastic body. More particularly, the closed loop has an operative position oriented transversely and centrally of the closed side panels, whereby limited slippage is permitted in the side panels under said closed loop. As a result, the loop is effective to maintain the side panels closed upon the plastic body while allowing for limited flexuring in the container to the extent of the referred to slippage, so that in combination with a magazine, for example, the two can be curved slightly during insertion into a mailbox, and otherwise exhibit an extent of flexibility which promotes proper handling during distribution to the consumer.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is an elevational view, as seen from the top, of an embodiment of a container for product samples according to the present invention, said container being in its normal unflexed condition;

FIG. 1*a* is a view similar to FIG. 1 but illustrating the container in a condition exhibiting the degree of flexuring of which it is capable because of the construction thereof according to the present invention;

FIG. 2 is a front elevational view of the container, as seen in the direction of the arrows 2—2 of FIG. 1, illustrating further structural details thereof;

FIG. 2*a* is a front elevational view similar to FIG. 2 but with portions of the components of the container broken away and in cross-section to illustrate additional structural features;

FIG. 3 is an exploded perspective view illustrating the manner in which the components which comprise the container are cooperatively arranged;

FIG. 4, like FIG. 3, is also a perspective view, but as seen in front elevation and also illustrates the various components of the container and the manner in which they are cooperatively assembled;

FIG. 5 is a perspective view illustrating the combining of the within container with a magazine into a unitary product;

FIG. 6 is a perspective view illustrating appropriate machinery for achieving the unitary product of FIG. 5; and FIG. 7 is a perspective view illustrating a typical use of the unitary product of FIG. 5, in which it is also illustrated how the flexuring of the within container facilitates achieving said use.

Figure 1:
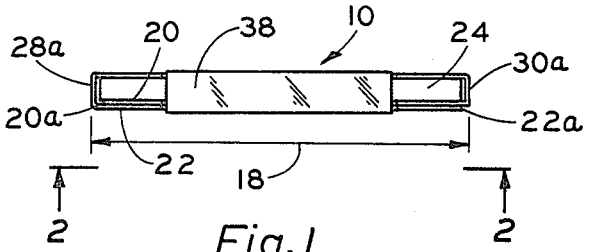
Figure 1A:
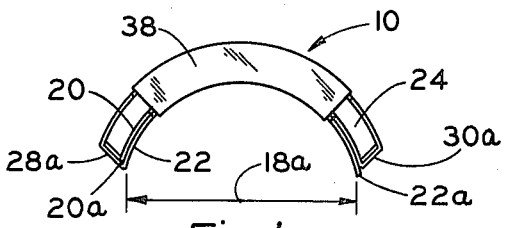

Upon preliminary reference to FIGS. 1, 1*a* and 7 of the drawings, there will be readily noted therein a member, generally designated 10, which will be understood to be a container for trial samples of various products which is ideally suited not only to protect the product samples against breakage but also, and even more important, to facilitate implementing a marketing concept of distributing these product samples to the consumer. That is, and as will be explained in greater detail subsequently, the product sample container 10 is readily adapted to be appropriately physically attached to a conventional magazine 12, thus forming the combination unitary product 14 which can be distributed to the ultimate consumer at newsstands or through other channels of distribution normally used for magazines and, as more particularly illustrated in FIG. 7, even distributed by mail, in which instance product 14 would typically be placed within a mailbox 16 and thus required to assume a slight curvature or flexuring, as illustrated in FIG. 7.

In the above regard, it is of course well understood that the usual magazine construction consisting of pages adhered along a spine readily allows flexuring in the magazine and one of the important aspects of the within invention is that the construction of the container 10, to be described in detail subsequently, also allows for flexuring and thus contributes to an extent of compatibility between the container 10 and magazine 12 which makes possible effective handling and distribution to the ultimate consumer of the referred to unitary product 14, again as exemplified by the mail delivery thereof of FIG. 7.

At this point in the description it is helpful to specifically note the flexuring capability of the container 10. In FIG. 1, a commercial embodiment of container 10 will typically call for a width dimension 18 of 8¼ inches, in a flat or unflexured configuration. However, in response to handling demands, as for example the positioning thereof within the restricted compartment of a mailbox, the container 10 must be capable of assuming a curved configuration in which the width 18 when measured flat is significantly reduced to a width of 18*a* which typically could be 6½ inches. To allow for the flexuring as above noted, container 10 in addition to embodying other components, is uniquely constructed of side panels 20 and 22 which close upon a plastic foam body 24 which houses and protects fragile product samples. The referred to panels 20 and 22 are effectively maintained in their closed position upon the body 24 in both the flat and flexured condition illustrated in FIGS. 1 and 1*a* as required and, additionally, in assuming the curved configuration illustrated in FIG. 1*a* the panels 20 and 22 move relative to each other, and this relative movement obviates any rupture or breakage of the container. More particularly, and as may be better appreciated from progressive examination of FIGS. 1 and 1*a*, the front edge 20*a* of the inwardly disposed panel 20 is allowed to move into a slight clearance space and also pushes, without adverse effect, against the container component in facing relation to said edge 20*a*, while the corresponding edge 22*a* of the external panel 22 is not restricted and is even projected beyond the side of the container 10 in assuming the curved configuration of FIG. 1*a*. The assumed position of the respective front edges 20*a* and 22*a* of the panels 20 and 22 demonstrates the relative movement that is allowed therebetween during the assumption of the curvature or flexuring in the container 10, while all the while the panels 20 and 22 and other components of the container are effectively maintained in enclosed relation about the fragile product samples, all as will now be described in detail.

Referring now to the additional FIGS. 2, 2*a*, 3 and 4 in conjunction with FIGS. 1 and 1*a*, it will be noted that the product sample container 10 includes a paperboard substrate that embodies the previously referred to panels 20 and 22 on the opposite sides of a rear panel 26. That is, and as is perhaps best illustrated in FIGS. 3 and 4, the cardboard substrate or blank is delineated by fold lines 28 and 30 into said back panel 26 and a left-side panel 20 and right-side panel 22, all of the panels 26, 20 and 22 being rectangularly shaped and approximately the same size. Completing the construction of the panels are centrally located upper and lower notches, individually and collectively designated 32, the function of which will soon be apparent.

Container 10 also includes in its construction the component, which also preferably is the one next embodied in its assembly, consisting of a rectangular body of plastic foam which was previously referred to by the reference numeral 24. Body 24 has a selected height 24*a* and has rectangular portions, individually and collectively designated 24*b*, removed therefrom to thereby form product sample-receiving compartments. In use, the plastic body 24 is adhesively secured to the face of the back panel 26 and samples of products, as exemplified by the heat sealed packets individually and collectively designated 34, which typically would contain a shampoo or other fluid contents and thus must be protected against breakage or rupture, are each disposed in a cooperating compartment 24*b*.

Next, the container 10 herein includes a transparent plastic sheet 36 which is appropriately adhesively secured, as along its peripheral edge, in convering relation over the plastic body 24 and thus effectively serves, at least in the areas thereof co-extensive with the compartments 24*b*, as closures for maintaining the product samples 34 within said compartments 24*b*.

Next in the assembly of the container 10 is the folding or closing movement of the side panels 20 and 22 upon the plastic body 24. In accordance with the present invention the shape of the container 10 when enclosed about the product samples 34 is required to be rectangular in cross-section, and thus advantageously having the same rectangular cross-sectional shape of a typical magazine. To achieve this, there is thus provided between the fold line 28 on one side and 30 on the opposite side a pair of spacing panels 28*a*, 30*a*, respectively. The width of the panels 28*a*, 30*a* is preferably the same dimension as the width 24*a* of the body 24, to thereby contribute to the rectangular cross-sectional shape in the container 10 when the side panels 20 and 22 are closed upon the body 24, or actually upon the plastic sheet 36 adhered to said body.

Figure 2:
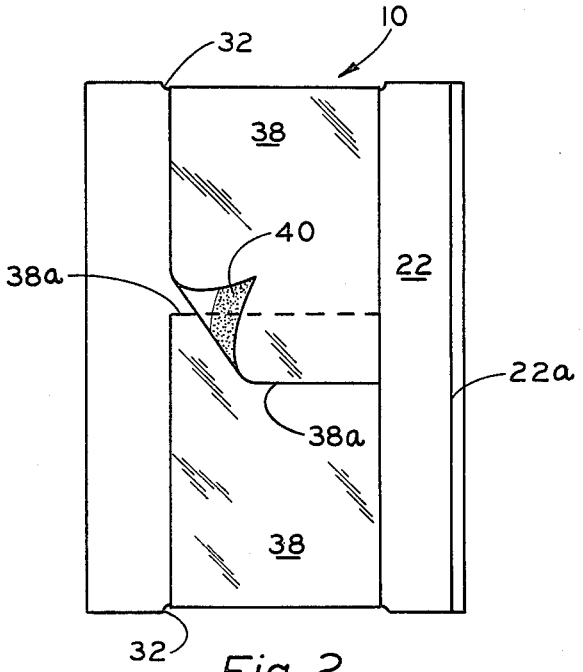
Figure 2A:
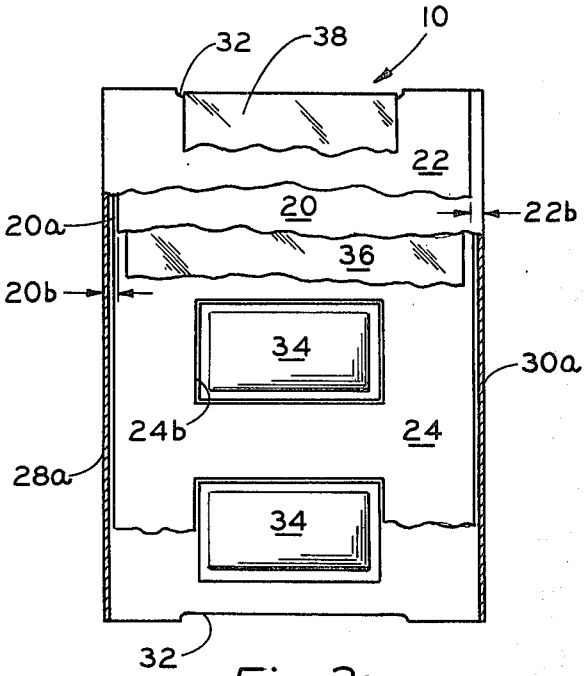
Figure 3:
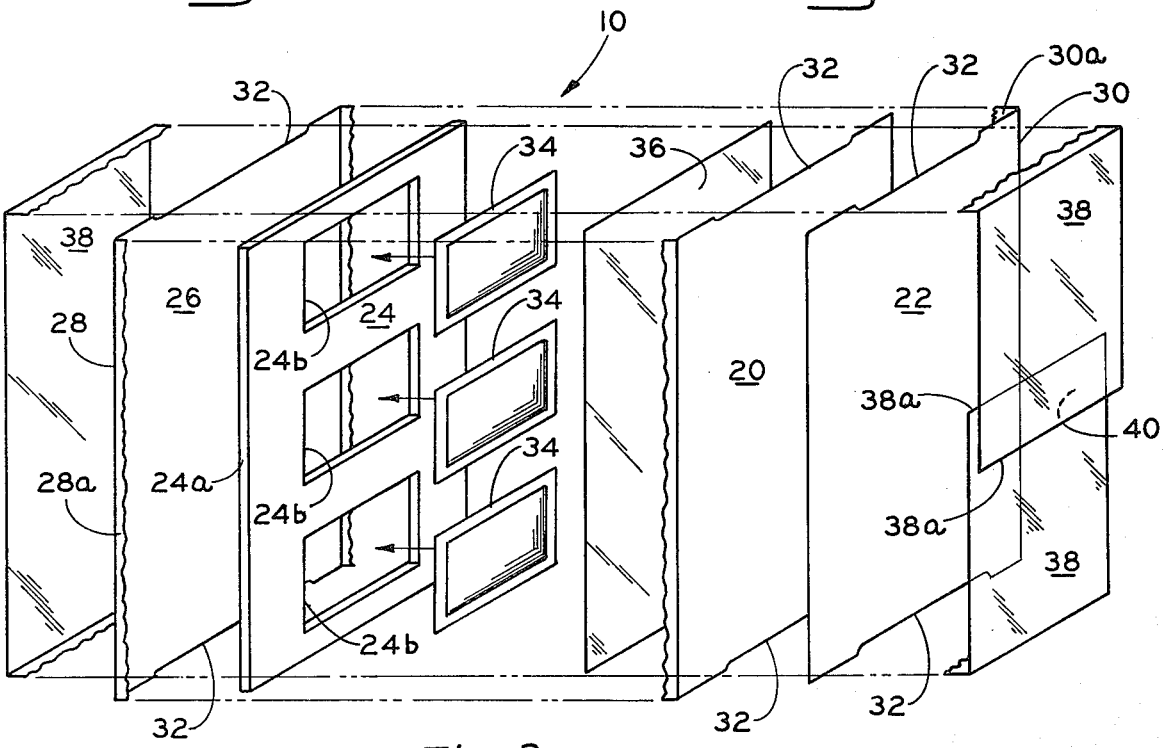

At this point in the description it is helpful to reiterate the explanation already provided regarding positional changes in the panel front edges 20*a*, 22*a*, and to illustrate the construction in the container 10, particularly in connection with FIG. 2*a* to which reference should be made, which makes allowances for these positional changes. More particularly, one edge 20*a* of panel 20 stops short of distance 20*b* of the spacing panel 28*a* and thus provides a clearance of 20*b* for movement of the edge 20*a* during the assuming of the FIG. 1*a* flexured condition of the container 10. Also, as already noted, in addition to the clearance 20*b*, edge 20*a* can push against and cause some movement in the spacing panel 28*a*, and thereby further increase the extent of relative movement between the panels 20 and 22.

Also, as is perhaps best shown in FIG. 2*a*, the panel edge 22*a* is short the distance 22*b* of the side panel 30*a*, and thus can be urged, without any adverse effect, through movement for the distance 22*b* and even therebeyond, as illustrated in exaggerated fashion for illustrative purposes in FIG. 1*a*.

Completing the construction of the container 10 is an elongated strip 38 which in a preferred embodiment is of transparent plastic construction material, said strip being formed into a closed loop and disposed in encircling relation about the container 10. That is, the opposite ends 38*a* of strip 38 are adhesively secured to each other at their overlap, as at 40, to thereby provide a closed loop having an operative position oriented transversely and centrally of the closed panels 20 and 22. To maintain the central location relative to the back panel 26 and side panels 20 and 22, the upper and lower portions of the strip 38 are seated in notches 32 of the edges of these panels. The closed loop formed by the strip 38 thus effectively maintains the panels 20 and 22 closed upon the plastic body 24 while at the same time not impeding or otherwise interfering with the movement of these panels relative to each other and also to the plastic body 24, a movement which is essential in order for the container 10 to assume a flexured condition, as illustrated for example in FIGS. 1*a* and 7, without the container being stressed or otherwise subjected to forces which could result in its breakage.

Reference should now be made to FIG. 5 illustrating details of the previously referred to unitary product 14 consisting of a typical magazine 12 and the within container 10. Using to advantage the surface presented by the back or so-called spine 12*a* of the magazine and the outer surface of the spacing panel 28*a* of the container 10, the magazine and container 10 are placed in adjacent position and an adhesive strip 42 is then used to form a physical connection therebetween, wherein the adhesive surface 44 of the strip is adhesively secured to the surfaces 12*a*, 28*a*. An adhesive tab 46 can be used to hold together the opposite edges of the integrated units 10, 12.

The FIG. 5 assembly can be achieved using a variety of available equipment. However, an assembling apparatus as illustrated in FIG. 6 is recommended. This apparatus, generally designated 50, includes end-to-end conveyors 52 and 54, the former conveyor 52 carrying into the assembly station the assembled merchandise-carrying containers 10, arranged one behind the other. At the assembly station, a similar end-to-end arrangement of magazines 12, is advantageously fed down a chute 56 so that each magazine 12 and a cooperating container 10 assume a superposed relation with each other on the conveyor 54. Assisted by a drive roller 58, conveyor 54 moves each cooperating assembly of magazine and container 12, 10 past a supply roll of tape 60 which is operatively arranged so that a supply length portion thereof, having an adhesive surface facing outwardly, is effectively transferred from roll 60 to an attached condition against the magazine spine 12*a* and container wall 28*a*, all as has already been explained in connection with FIG. 5. After application of the strip 42 at station 62, the combination products 14 are forced along a slightly curved track 64 which induces a slight opening 66 between adjacent products. A reciprocating scissor 68 is appropriately coordinated in its up and down movement and also in its cutting operation so as to sever the tape 42, as at location 70, thereby separating the combination products from each other.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A flexuring container for fragile product samples comprised of a paperboard blank delineated into a similarly sized rectangularly shaped back panel and a pair of opposite side panels, a pair of spacing panels each of an elongated rectangular shape and of a selected width interconnecting each said side panel along an edge of said back panel, a body of plastic foam construction material with selected portions removed to form product sample-receiving compartments having an operative position adhesively secured to said back panel, said height of said plastic body being of the same extent as the width of said spacing panels and said shape and size thereof being of the same extent as said back panel, a clear plastic sheet disposed in covering relation over said plastic body to serve as a closure for said compartments therein, and a strip formed into a closed loop disposed in encircling relation over the operative positions of said side panels closed upon said plastic body, said closed loop having an operative position oriented transversely and centrally of said closed side panels, whereby limited slippage is permitted in said side panels under said closed loop which continues to maintain said side panels closed upon said plastic body while allowing corresponding limited flexuring in said container to the extent of said slippage.

2. A container for product samples as claimed in claim 1 wherein said construction material of said closed loop is clear plastic so as to render visible therethrough any printing on said underlying side panel.

3. A container for product samples as claimed in claim 2 including a magazine having a spine in adjacent position to said container, and an adhesive strip adhesively connected to said magazine spine and one said spacing panel of said container to thereby form a unitary product thereof.

4. A container for product samples as claimed in claim 2 wherein opposite upper and lower edges of said back and side panels have a central notch therein for maintaining said central position of said closed loop in relation to said panels.

5. A flexuring container for fragile product samples comprised of a paperboard blank delineated into a similarly sized rectangularly shaped back panel and a pair of opposite side panels, a pair of spacing panels each of an elongated rectangular shape and of a selected width interconnecting each said side panel along an edge of said back panel, a body of plastic foam construction material with selected portions removed to form product sample-receiving compartments having an operative position adhesively secured to said back panel, said height of said plastic body being of the same extent as the width of said spacing panels and said shape and size thereof being of the same extent as said back panel, and a strip formed into a closed loop disposed in encircling relation over the operative positions of said side panels closed upon said plastic body, said closed loop having an operative position oriented transversely and centrally of said closed side panels, whereby limited slippage is permitted in said side panels under said closed loop which continues to maintain said side panels closed upon said plastic body while allowing corresponding limited flexuring in said container to the extent of said slippage.

* * * * *